US011998817B2

(12) United States Patent
Moran

(10) Patent No.: US 11,998,817 B2
(45) Date of Patent: Jun. 4, 2024

(54) BALL GAME APPARATUS USING A RACQUET AND METHOD OF USING THE SAME

(71) Applicant: Mark Moran, Sterling, VA (US)

(72) Inventor: Mark Moran, Sterling, VA (US)

( * ) Notice: Subject to any disclaimer, the term of this patent is extended or adjusted under 35 U.S.C. 154(b) by 0 days.

(21) Appl. No.: 16/666,243

(22) Filed: Oct. 28, 2019

(65) Prior Publication Data

US 2021/0121756 A1 Apr. 29, 2021

(51) Int. Cl.
*A63B 67/04* (2006.01)
*A63B 41/00* (2006.01)

(52) U.S. Cl.
CPC ..... *A63B 67/04* (2013.01); *A63B 41/00* (2013.01); *A63B 2220/801* (2013.01); *A63B 2220/833* (2013.01); *A63B 2225/74* (2020.08)

(58) Field of Classification Search
CPC ..... A63B 67/00; A63B 67/04
See application file for complete search history.

(56) References Cited

U.S. PATENT DOCUMENTS

| | | | | |
|---|---|---|---|---|
| 4,703,931 | A * | 11/1987 | Steen | A63B 69/0097 473/197 |
| 6,569,028 | B1 * | 5/2003 | Nichols | A63B 69/3694 473/153 |
| 6,607,455 | B1 * | 8/2003 | Petras | A63B 69/0097 273/400 |
| 2011/0059816 | A1 * | 3/2011 | Campanaro | A63B 69/0097 473/435 |
| 2016/0045800 | A1 * | 2/2016 | Traustason | A63B 69/002 473/435 |
| 2017/0197128 | A1 * | 7/2017 | Peterson | A63B 71/0605 |

* cited by examiner

*Primary Examiner* — Eugene L Kim
*Assistant Examiner* — Christopher Glenn
(74) *Attorney, Agent, or Firm* — Law Office of Jerry Joseph, PLC; Jerry K. Joseph

(57) ABSTRACT

A ball game apparatus including a centerpiece apparatus member having an outer frame member, an inner frame member, and a raised platform surface disposed within the inner frame member, a plurality of shaped members coupled between the outer and inner frame members, and a ball member configured to bounce off the raised platform surface and the plurality of shaped members.

18 Claims, 11 Drawing Sheets

140

BALL GAME APPARATUS USING A RACQUET AND METHOD OF USING THE SAME

BACKGROUND OF THE INVENTION

1. Field of the Invention

The present general inventive concept relates to a racquet sport, and more particularly, to a ball game using a racquet designed for multiple player configurations, including one-on-one, two-on-two, and three-on-three.

2. Description of Related Art

There are many forms of ball games that have been previously developed. These ball games typically include a flat surface on which balls are designed to bounce off.

Further, there has been a ball game that was developed that players use racquets to strike a rubber ball onto a centrally placed disc. However, since this disc has a concave surface, the rubber ball can bounce off in many random directions without being slowed down and, as a result, the outer perimeter of the playing court needs to be surrounded by a net.

In addition, typical racquets used in these types of games generate a tremendous amount of torque on the players wrist and joints, which often causes injury to the players.

Therefore, what is desired is a ball game apparatus and method using a racquet designed to control the ball speed and direction and which reduces the risk of injury to the player.

SUMMARY OF THE INVENTION

The present general inventive concept provides a ball game apparatus using a racquet designed to control the ball speed and direction of the ball member.

The foregoing and/or other aspects of the present general inventive concept are achieved by providing a ball game using a racquet including a centerpiece apparatus member having an outer frame member, an inner frame member, and a raised platform surface disposed within the inner frame member, a plurality of shaped members coupled between the outer and inner frame members, and a ball member configured to bounce off the raised platform surface and the plurality of shaped members.

The outer frame member and the inner frame member may be formed in a polygonal shape.

The outer frame member and the inner frame member may be formed in a hexagonal shape.

The plurality of shaped surfaces may be angled with respect to the raised inner surface.

The plurality of shaped surfaces may be formed in a trapezoid shape.

The raised inner surface may be formed in a hexagonal shape.

The outer and inner frame members may be formed in a hexagonal shape.

The foregoing and/or other aspects of the present general inventive concept are achieved by also providing a ball game apparatus including a centerpiece apparatus member having an outer frame member, an inner frame member, and a raised platform surface disposed within the inner frame member, a plurality of shaped members coupled between the outer and inner frame members, at least one sensor coupled to the centerpiece apparatus, a light emitting member coupled to the at least one sensor, and a ball member configured to bounce off the raised platform surface and the plurality of shaped members, wherein the light emitting member emits a first colored light when the at least one sensor detects contact by the ball member on the raised platform surface or the plurality of shaped members and a second colored light when the at least one sensor detects contact by ball member on a vertical face of the outer frame member.

Additional aspects and/or advantages of the general inventive concept will be set forth in part in the description which follows and, in part, will be obvious from the description, or may be learned by practice of the general inventive concept.

BRIEF DESCRIPTIONS OF THE DRAWINGS

These and/or other aspects of the present general inventive concept will become apparent and more readily appreciated from the following description of the embodiments, taken in conjunction with the accompanying drawings of which:

DESCRIPTION OF INVENTION

Figure 1:
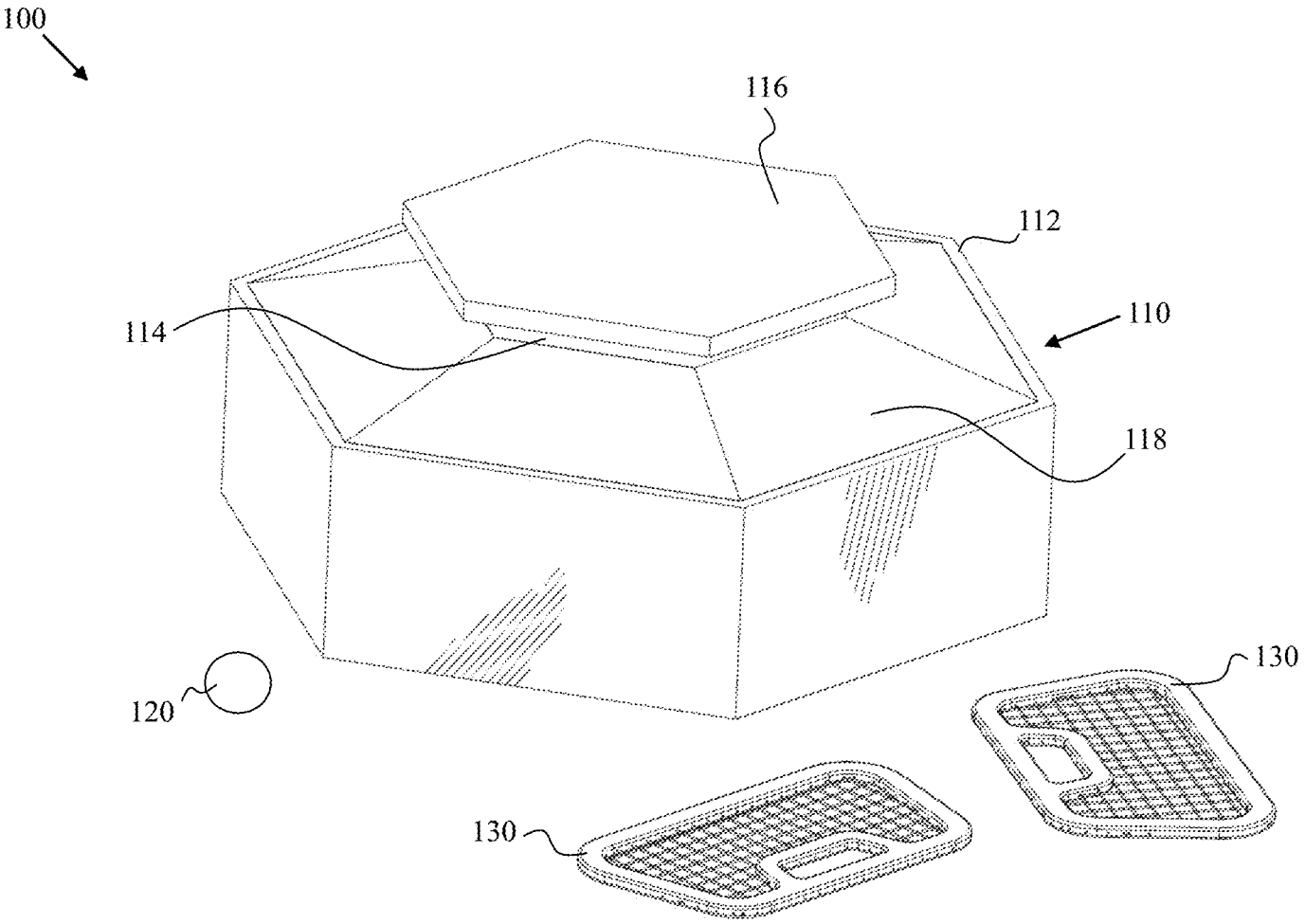
FIG. 1 illustrates a front perspective view of a ball game apparatus using a racquet according to an exemplary embodiment of the present general inventive concept, including a centerpiece apparatus, a ball member, and a racquet member.

Reference will now be made in detail to the exemplary embodiments of the present general inventive concept, examples of which are illustrated in the accompanying drawings, wherein like reference numerals refer to the like elements throughout. The exemplary embodiments are described below in order to explain the present general inventive concept by referring to the figures.

Figure 2:
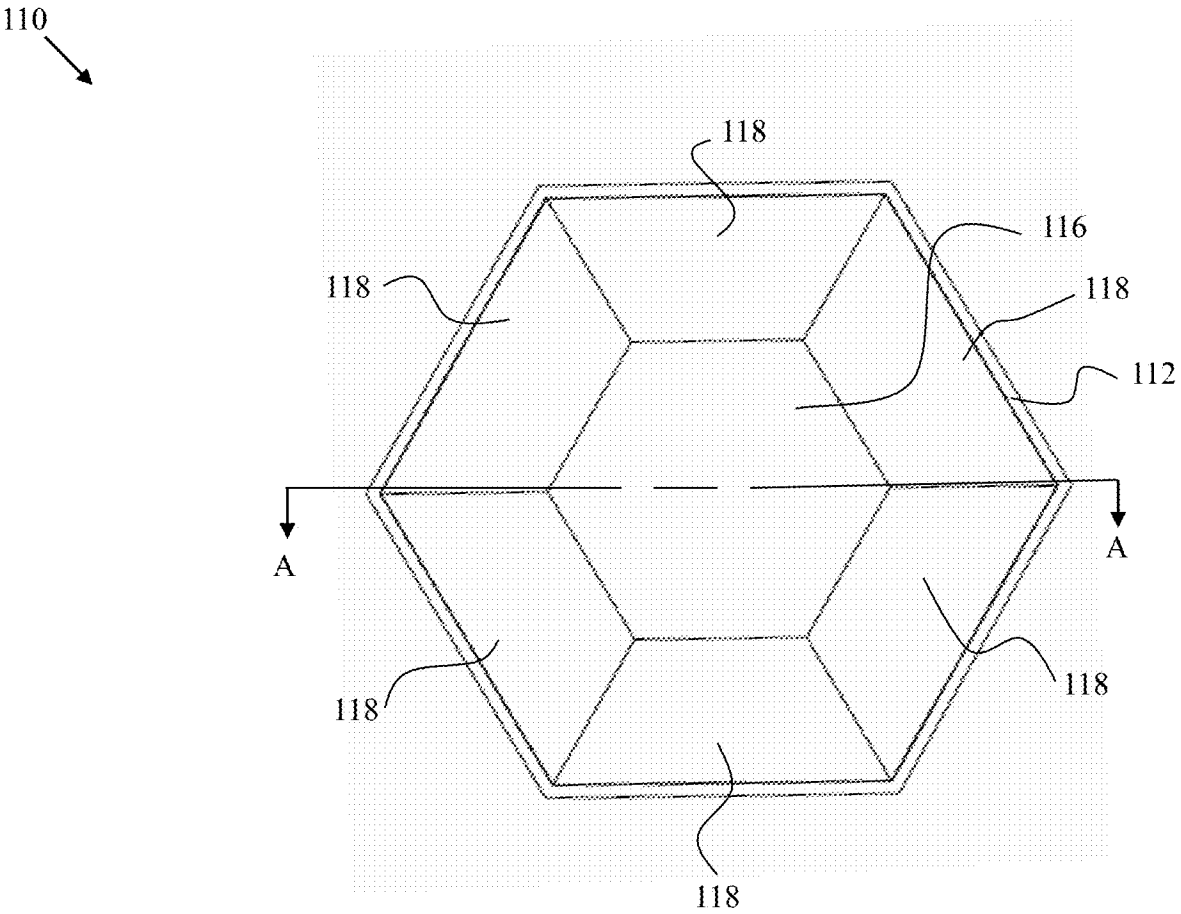
FIG. 2 is a top plan view of the centerpiece apparatus illustrated in FIG. 1.
Figure 3:
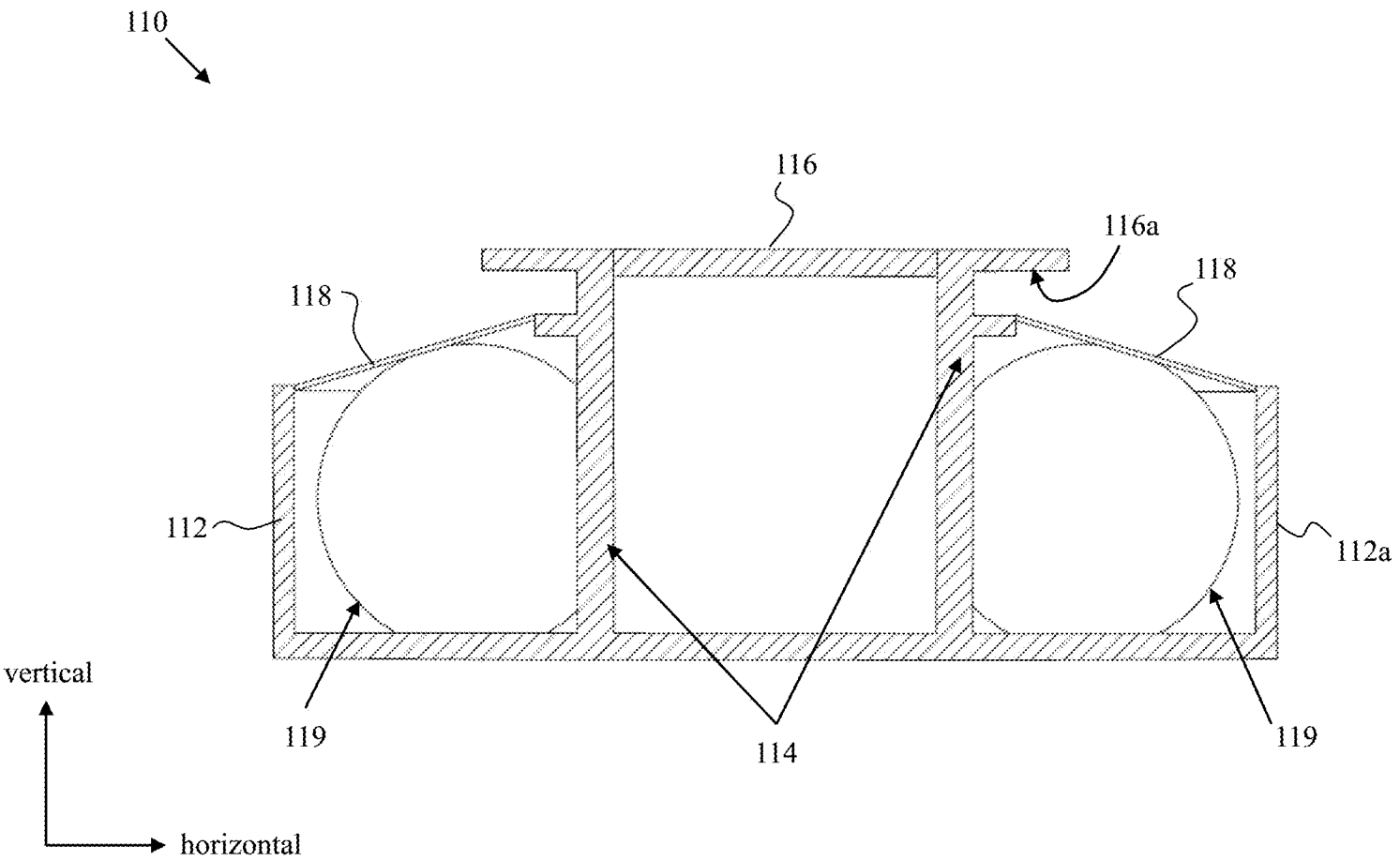
FIG. 3 is a cross-sectional view of the centerpiece apparatus illustrated in FIG. 1, along line A-A.

FIG. 1 illustrates a front perspective view of a ball game apparatus 100 according to an exemplary embodiment of the present general inventive concept, including a centerpiece apparatus 110, a ball member 120, and a racquet member 130. FIG. 2 is a top plan view of the centerpiece apparatus 110 illustrated in FIG. 1 and FIG. 3 is a cross-sectional view of the centerpiece apparatus 110 illustrated in FIG. 1, along line A-A.

Referring to FIG. 1, the ball game apparatus 100 according to the present general inventive concept includes a centerpiece apparatus 110 formed as a three-dimensional, hexagonally shaped platform, a ball member 120 formed from an elastic material such as rubber or the like, and a racquet member 130 formed in a trapezoidal shape. However, the present general inventive concept is not limited thereto.

In the present embodiment, the centerpiece apparatus 110 includes a hexagonally shaped outer frame member 112, a hexagonally shaped inner frame member 114 disposed within the outer frame member 112, and a hexagonally shaped raised platform surface 116 coupled to the inner frame member 114. The centerpiece apparatus 110 further includes a plurality of shaped members 118 formed in a trapezoidal shape coupled in an angled position between the inner and outer frame members 114, 112.

The ball member 120 is designed and/or configured to bounce off each of the surfaces of the centerpiece apparatus 110 including the plurality of shaped members 118 and the hexagonally shaped raised platform surface 116.

Referring to FIG. 3, in the present embodiment, the centerpiece apparatus 110 includes six shaped members 118 which are each angled from the inner frame member 114 toward the outer frame member 112. As such, the six shaped members 118 connect the outer and inner hexagonal frame members 112, 114 and surround the raised platform surface 116.

In exemplary embodiments, the plurality of shaped members 118 are angled from the outer frame member 112 toward the inner frame member 114 at about 2 degrees to about 85 degrees and are coupled to the inner frame member 114 a few inches beneath a bottom surface 116*a* of the raised platform surface 116. As such, the plurality of shaped surfaces 118 may be angled with respect to the raised platform surface 116. However, the present general inventive concept is not limited thereto.

In exemplary embodiments, the plurality of shaped members 118 may be formed in a trapezoidal shape. However, the present general inventive concept is not limited thereto.

In exemplary embodiments, the centerpiece apparatus 110 may be constructed in various shapes and sizes, having at least two planar edges and/or surfaces. The centerpiece apparatus 110 may be constructed from wood, plastic, or the like. However, the present general inventive concept is not limited thereto.

That is, in exemplary embodiments, the outer frame member 112 and/or the inner frame member 114 may be formed in various polygonal shapes.

Referring to FIG. 3, in exemplary embodiments, the centerpiece apparatus 110 may further include one or more elastic members 119 disposed between the inner and outer frame members 114, 112 and the plurality of shaped members 118. The one or more elastic members 119 may be formed as an inflatable ball or sphere and configured to control and/or improve bounce characteristics of the ball member 120 when bounced off the centerpiece apparatus 110. That is, by increasing an amount of air disposed within the one or more elastic members 119, the ball member 120 may bounce off the plurality of shaped 118 members with a greater velocity. Conversely, by decreasing an amount of air disposed within the one or more elastic members 119, the ball member 120 may bounce off the plurality of shaped 118 members with a lower velocity.

In alternative embodiments, the one or more elastic members 119 may include a spring mechanism (not illustrated) designed and/or configured to control bounce characteristics of the ball member 120 when bounced off the plurality of shaped members 118 of the centerpiece apparatus 110.

Figure 4:
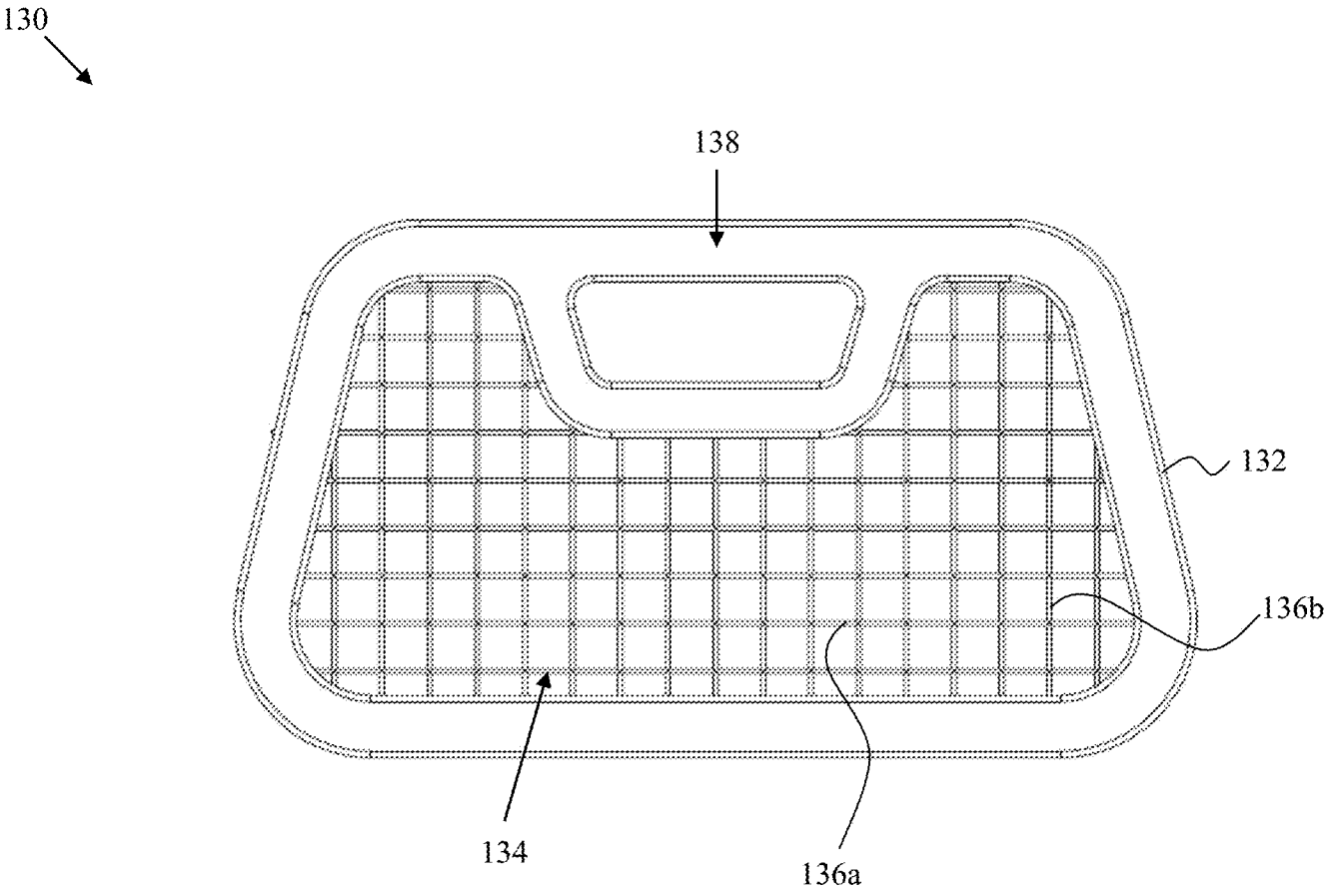
FIG. 4 is a top plan view of the racquet member illustrated in FIG. 1.

FIG. 4 is a top plan view of the racquet member 130 illustrated in FIG. 1.

In the present embodiment, the racquet member 130 is formed with a trapezoidal shaped frame 132 and a generally planar string bed 134 formed by longitudinal strings 136*a* and transverse strings 136*b*. The trapezoidal shaped frame 132 includes a handle 138 along one side of the frame 132 designed to be gripped by a user 10 (e.g., a player).

In the present embodiment, the trapezoidal shaped frame 132 may be constructed from wood, plastic, or the like. However, the present general inventive concept is not limited thereto. That is, in alternative embodiments, the trapezoidal shaped frame 132 may be constructed from a composite material having fibers and resin.

Figure 5:
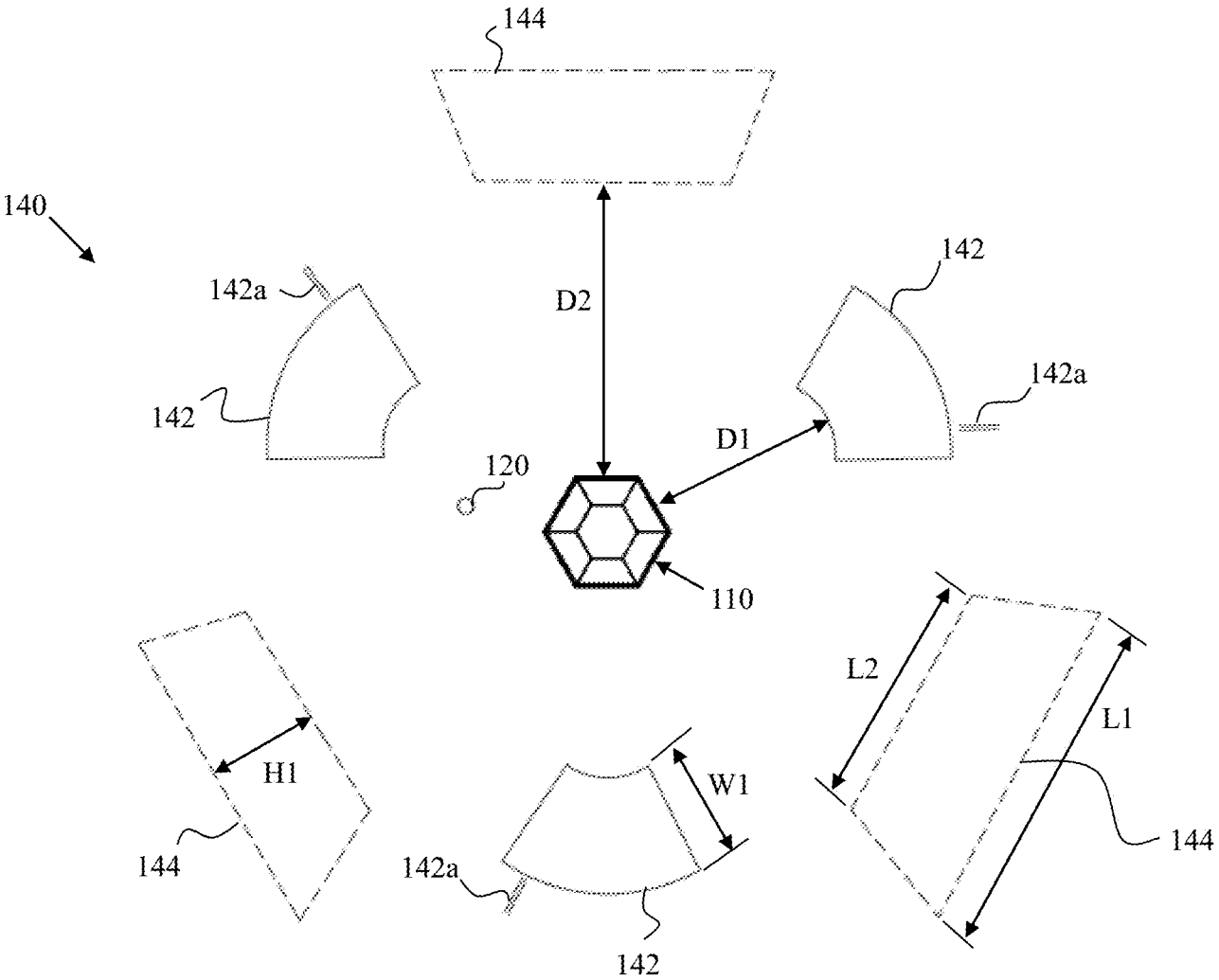
FIG. 5 is a top plan schematic view of a floor marking layout for the ball game apparatus using a racquet according to an exemplary embodiment of the present general inventive concept.
Figure 6:
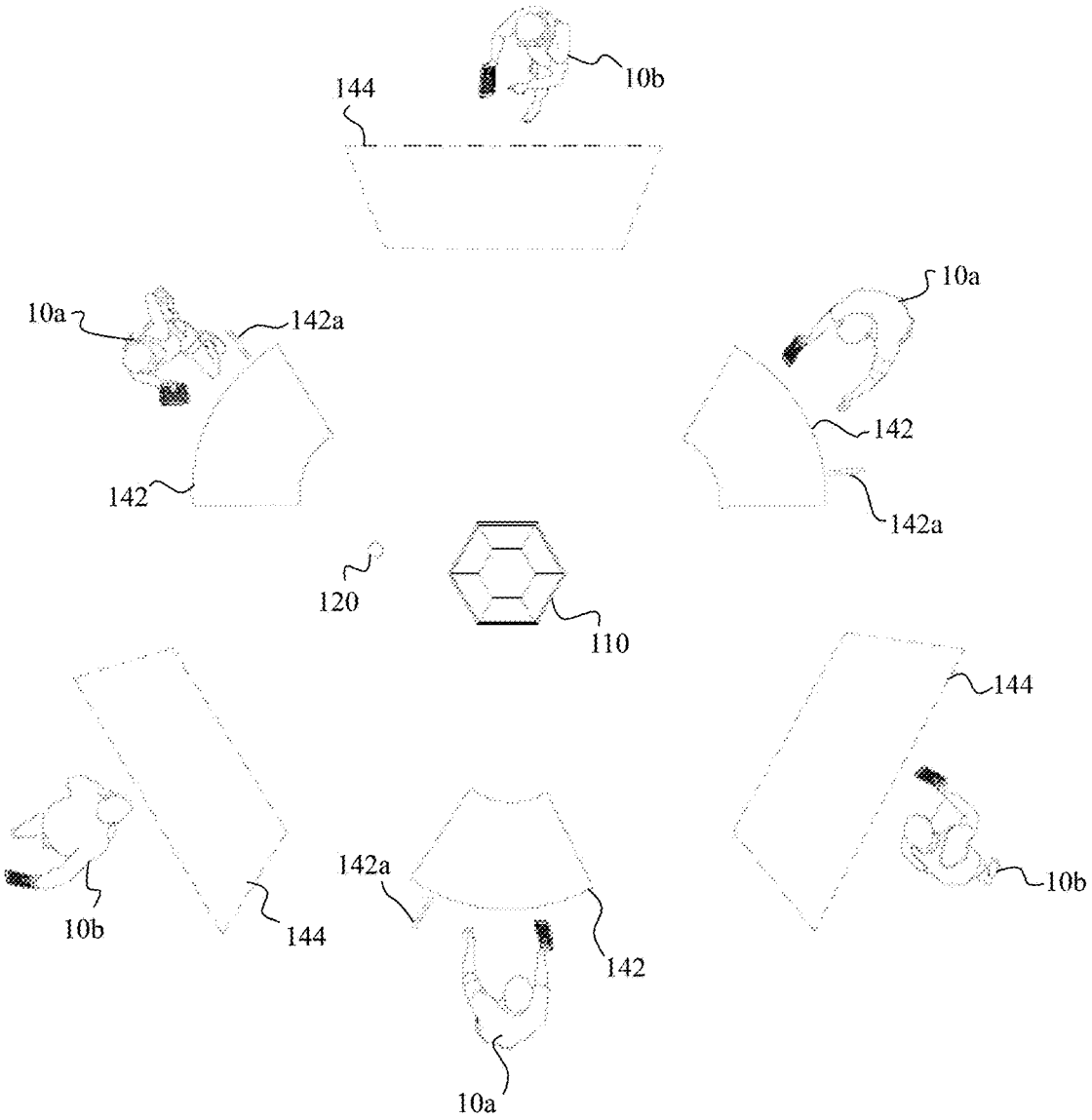
FIG. 6 is a top plan schematic view of the floor marking layout for the ball game apparatus using a racquet illustrated in FIG. 5 with players in a three-on-three configuration.
Figure 7:
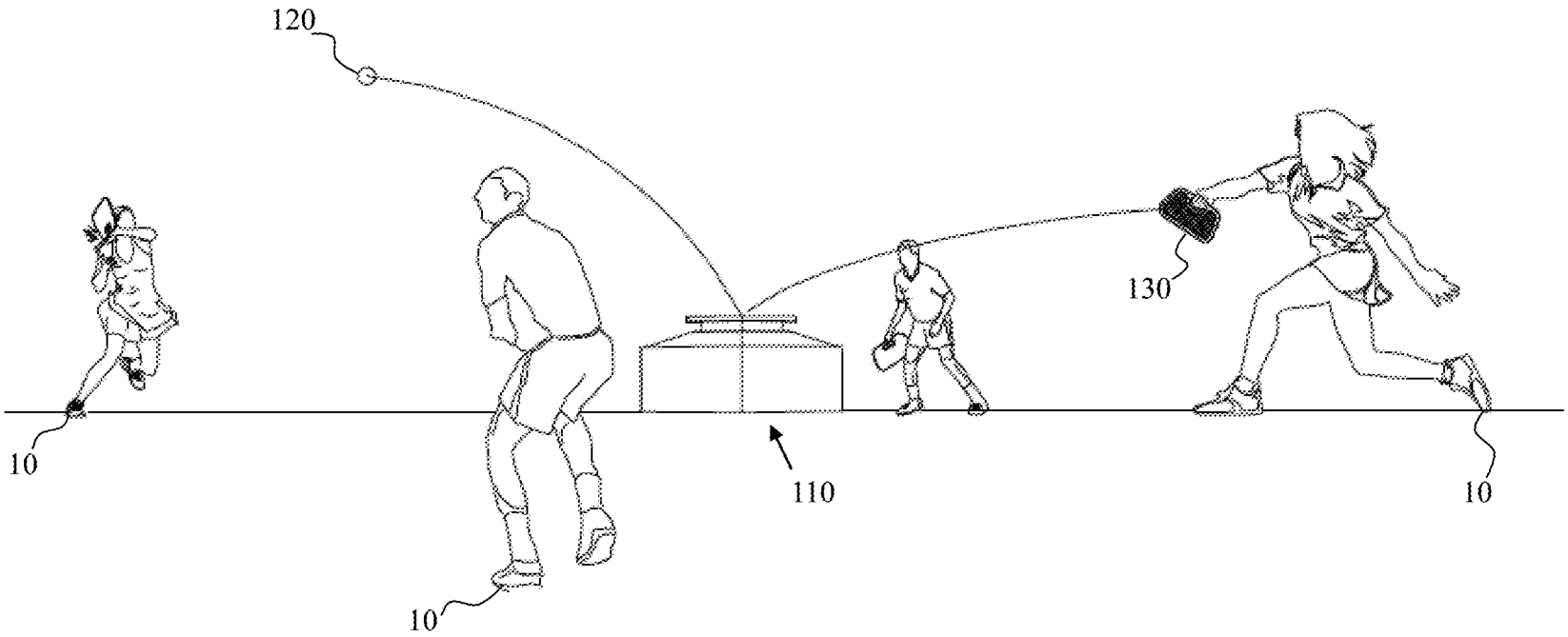
FIG. 7 is a front perspective view of the ball game apparatus using a racquet illustrated in FIG. 1 with players in a two-on-two configuration.

FIG. 5 is a top plan schematic view of a floor marking layout 140 for the ball game apparatus using a racquet 100 according to an exemplary embodiment of the present general inventive concept. FIG. 6 is a top plan schematic view of the floor marking layout 140 for the ball game apparatus using a racquet 100 illustrated in FIG. 5 with players in a three-on-three configuration.

In the present embodiment, the floor markings 140 also referred to as "hopswatches" are zones placed on the floor. There are three hopswatches having a first shape 142 placed near the centerpiece apparatus 110 and three hopswatches having a second shape 144 placed further away from the centerpiece apparatus 110. There are service hashes 142*a* placed behind each hopswatch having the first shape 142. In the present embodiment, the first shape may include an arc shape and the second shape may include a trapezoid shape. Also, in the present embodiment, the first shape may be different than the second shape. However, the present general inventive concept is not limited thereto.

Figure 8:
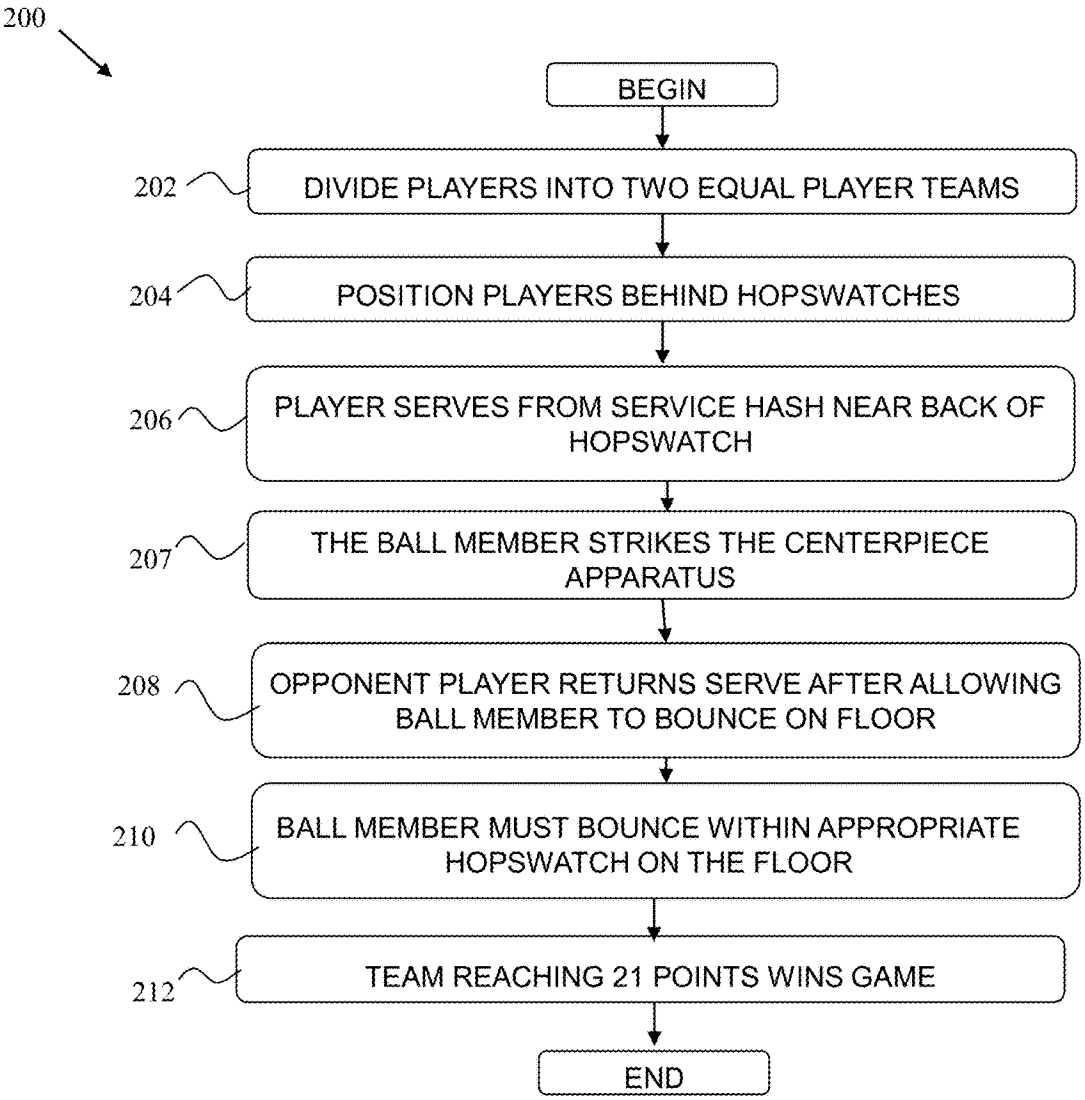
FIG. 8 is a flow diagram illustrating a method for instructing players on playing a game using the ball game apparatus disclosed herein according to various embodiments presented herein of the present general inventive concept.

FIG. 8 is a flow diagram illustrating a method 200 for instructing players on playing a game using the ball game apparatus 100 disclosed herein according to various embodiments of the present general inventive concept.

The game or routine begins at operation 202 by dividing the players into two teams of equal players. The routine can be played in various configurations including one player versus one player, two players versus two players, or three players versus three players.

At operation 204, each player on a team stands behind hopswatches having the same shape and/or distance away from the centerpiece apparatus 110. For example, a first team stands behind the first-shaped hopswatches 142 placed at a first distance D1 away from the centerpiece apparatus 110 and a second team stands behind the second-shaped hopswatches 144 placed at a second distance D2 away from the centerpiece apparatus 100. The first distance D1 being shorter than the second distance D2. Further, the hopswatches alternate from a first-shaped hopswatch 142 placed at the first distance D1 to a second-shaped hopswatch 144 placed at the second distance D2 in a circular direction centered about the centerpiece apparatus 110.

In exemplary embodiments, the first shaped hopswatches 142 may have a width W1 of about 12 inches to about 60 inches and the second shaped hopswatches 144 may have a height H1 of about 12 inches to about 60 inches. The second shaped hopswatches 144 may have a long base length L1 of about 48 inches to about 145 inches and a short base length L2 of about 45 inches to about 145 inches. The first distance D1 may be about 24 inches to about 60 inches and the second distance D2 may be about 60 inches to about 145 inches. However, the present general inventive concept is not limited thereto.

At operation 206, each member of the first team 10*a* takes turns serving from the service hash 142*a* (i.e. hitting the ball member 120 using the racquet 130) toward the second team 10*b*.

At operation 207, the ball member 120 must strike the raised platform surface 116 during only the serve and then bounce within an opposing hopswatch, in a single bounce. That is, during the serve, the ball member 120 must strike the hexagonally shaped raised platform surface 116. However, if the serve fails to bounce within the opposing hopswatch, this results in a fault. The players are given two opportunities to serve without faulting.

At operation 208, the player on the second team 10*b* (i.e., opponent) must return the ball member 120 after allowing a single bounce on the floor within a hopswatch. Using the racquet member 130, the opponent must send the ball member 120 to bounce off any face of the centerpiece apparatus 110, except for its vertical faces 112*a*, and then onto any hopswatch on the floor, excluding the hopswatch directly in front of the racquet member 130. During the serve, no player can step into any hopswatch 142, 144. However, after the serve, all players may step into any second shaped hopswatches 144, without faulting.

At operation 210, in an embodiment, during play in a one-on-one configuration, the hopswatches on either side of the racquet member 130 are out of bounds.

In the present embodiment, players must never step within the first shaped hopswatches 142 during play. Also, the players must never step within the second shaped hopswatches 144 during a serve, as doing so would result in a fault.

In the present embodiment, the ball member 120 is considered out of play if it strikes a player during the game. If the serving team hits the ball member 120 and it strikes the opposing team, the serving team loses its serve to the opposing team. If the opposing team hits the ball member 120 and it strikes the serving team, the serving team wins a point.

Further, when the ball member 120 goes out of play, the serving team (i.e., first team 10*a*) scores a point when the second team 10*b* causes the fault or the service changes to the opposing team (i.e., second team 10*b*) when the first team 10*a* causes the fault.

In alternative embodiments, for instance two-on-two or three-on-three configurations, the server must change hands the next time side out brings service back to the team (e.g., the players rotate).

In operation 212, a typical scoring system for this game is up to 21. The team reaching 21 point is considered the winner of the game. However, the present general inventive concept is not limited thereto. That is, in alternative embodiments, the scoring system may be modeled after the scoring system used in various other games, including tennis.

Figure 9:
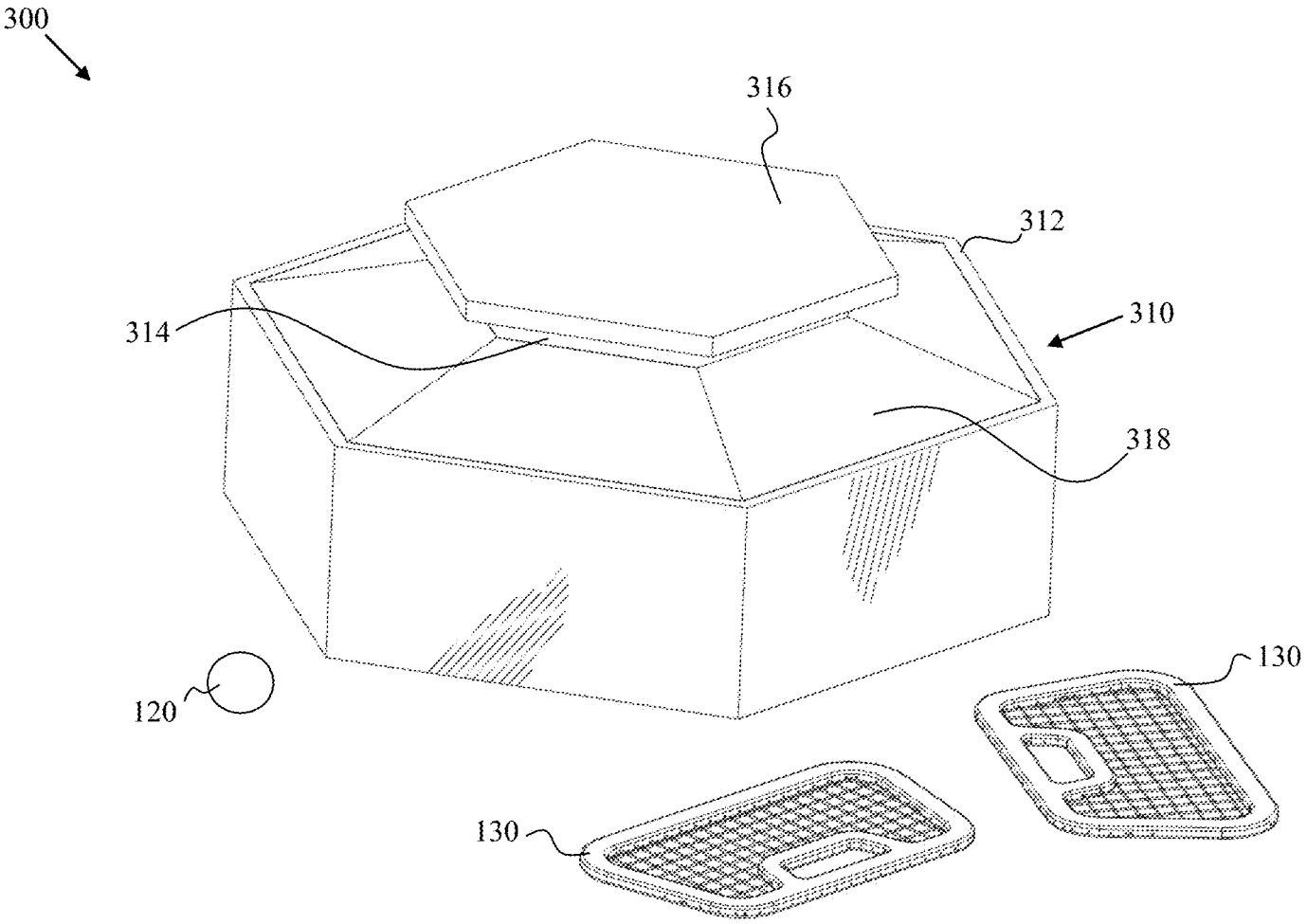
FIG. 9 illustrates a front perspective view of a ball game apparatus using a racquet according to another exemplary embodiment of the present general inventive concept, including a centerpiece apparatus having at least one sensor and light emitting member, a ball member, and a racquet member.
Figure 10:
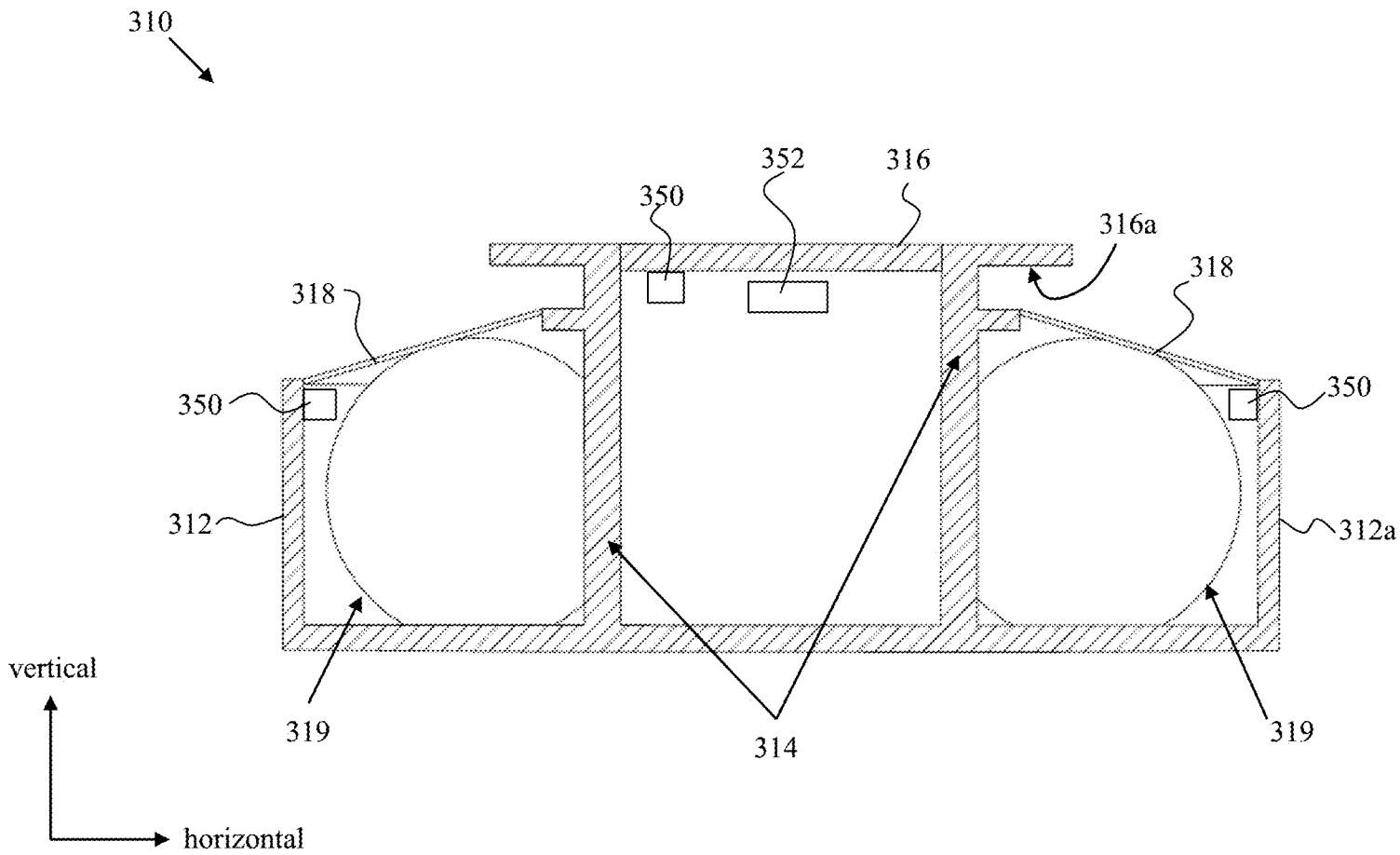
FIG. 10 is a cross-sectional view of a centerpiece apparatus according to another embodiment of the present inventive concept.

FIG. 9 illustrates a front perspective view of a ball game apparatus using a racquet 300 according to another exemplary embodiment of the present general inventive concept, including a centerpiece apparatus 310 having at least one sensor 350 and a light emitting member 352, a ball member 120, and a racquet member 130. FIG. 10 is a cross-sectional view of a centerpiece apparatus 310 illustrated in FIG. 9 and FIG. 11 is a top plan schematic view of a floor marking layout 340 for the ball game apparatus using a racquet 300.

Referring to FIGS. 9 and 10, in the present embodiment, the ball game apparatus 300 according to the present general inventive concept includes a centerpiece apparatus 310 formed as a three-dimensional, hexagonally shaped platform, a ball member 120 formed from an elastic material such as rubber or the like, and a racquet member 130 formed in a trapezoidal shape. The centerpiece apparatus 310 further includes at least one sensor 350 and a light emitting member 352 designed to emit a light when the ball member 120 strikes various parts of the centerpiece apparatus 310. For instance, the light emitting member 352 emits a first colored light (e.g., green light) when the at least one sensor 350 detects contact by the ball member 120 on the raised platform surface 316 or on the plurality of shaped members 318 and a second colored light (e.g., red light) when the at least one sensor 350 detects contact by the ball member 120 on a vertical face 312*a* of the outer frame member 312.

Figure 11:
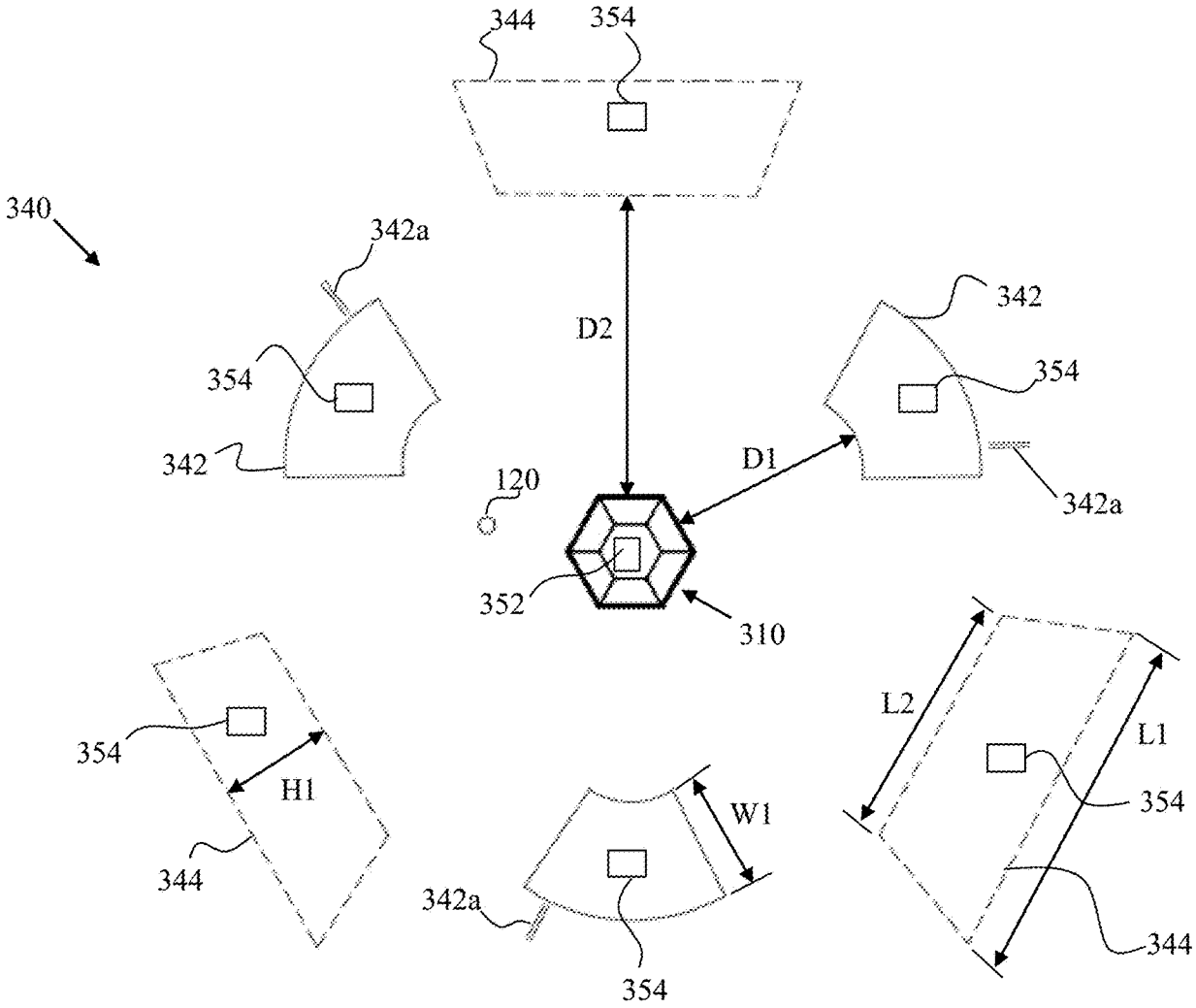
FIG. 11 is a top plan schematic view of a floor marking layout for a ball game apparatus using a racquet according to another exemplary embodiment of the present general inventive concept.

Referring to FIG. 11, in the present embodiment, the floor markings 340 also referred to as "hopswatches" are zones placed on the floor. Similar to the previous embodiment, there are three hopswatches having a first shape 342 placed near the centerpiece apparatus 310 and three hopswatches having a second shape 344 placed further away from centerpiece apparatus 310. There are service hashes 342*a* placed behind each hopswatch having the first shape 342. In the present embodiment, each of the hopswatches further include a sensor 354 configured to detect whether a player steps on or within the hopswatch 342, 344 during play. For instance, when the sensor 354 detects that a player that stepped within the first shaped hopswatches 342 during play, the light emitting member 354 of the centerpiece apparatus 310 emits the second colored light (e.g. red light). Also, the light emitting member 354 emits the second colored light when the sensor 354 detects that a player that stepped within the second shaped hopswatches 344 during a serve, as doing so would result in a fault. However, the present general inventive concept is not limited thereto. That is, in alternative embodiments, the centerpiece apparatus 310 may display a colored light and/or sound an alarm when any fault occurs during play.

A ball game using a racquet is provided. The ball game apparatus using a racquet includes a centerpiece apparatus, a ball member, a racquet member, and a floor marking layout, including a plurality of hopswatches. The ball game includes a polygonal centerpiece apparatus supporting a raised planar platform having a polygonal shape. The raised planar platform may be the same or a different shape than the centerpiece apparatus.

The centerpiece apparatus is formed with an outer frame having at least two edges which supports a plurality of movable or flexible platform members disposed around the raised planar platform. In an embodiment, the outer frame is formed in a hexagonal shape, the movable or flexible platform members are formed in a trapezoid shape, and the raised planar platform is formed in a hexagonal shape. However, the present general inventive concept is not limited thereto.

The centerpiece apparatus is positioned in the center of floor markings referred to as "hopswatches" that are zones placed on the floor. There are three hopswatches having a first shape placed near the centerpiece apparatus and three hopswatches having a second shape different than the first shape placed further away from centerpiece apparatus.

The centerpiece apparatus includes a plurality of elastic members within the outer frame and in contact with the plurality of movable trapezoid platform members. The plurality of elastic members may be formed in a spherical shape designed to allow the movable trapezoid platform members to flex and spring back when a ball member is bounced off an upper/outer surface of the trapezoid platform.

In exemplary embodiments, the amount of flex and spring back of the platform members may be controlled by controlling an amount of air disposed within the plurality of elastic members. That is, by increasing the amount of air within the plurality of elastic members, the amount of flex and spring back of the platform members is reduced.

Although a few exemplary embodiments of the present general inventive concept have been illustrated and described, it will be appreciated by those skilled in the art that changes may be made in these exemplary embodiments without departing from the principles and spirit of the general inventive concept, the scope of which is defined in the appended claims and their equivalents.

What is claimed is:

1. A ball game apparatus, comprising:

a centerpiece apparatus member having an outer frame member, an inner frame member disposed inside the outer frame member, and a raised platform surface disposed on the inner frame member so as to be supported at a level above the outer frame member;

a plurality of shaped members coupled between the outer and inner frame members, a number of the plurality of shaped members corresponding to a number of players using the ball game apparatus, a top surface of the raised platform surface and a top surface of each of the shaped members configured such that a ball member formed from an elastic material will bounce off the raised platform top surface or the top surfaces of the shaped members, and a plurality of elastic members corresponding in number to the number of the plurality of shaped members, each elastic member disposed between the outer frame member and the inner frame member and a respective one of the shaped members, the elastic members configured to control a bounce characteristic of the ball member off the top surfaces of the shaped members, wherein a top end of the outer frame member is spaced from a top end of the inner frame member, the plurality of shaped members are coupled between the top end of the outer frame member and the top end of the inner frame member, and each shaped member is directed toward a respective player position spaced from the shaped member.

2. The ball game apparatus of claim 1 wherein the outer frame member and the inner frame member are formed in a polygonal shape.

3. The ball game apparatus of claim 2, wherein the outer frame member and the inner frame member are formed in a hexagonal shape.

4. The ball game apparatus of claim 1, wherein each shaped member of the plurality of shaped members is angled with respect to the raised platform surface.

5. The ball game apparatus of claim 4, wherein the outer and inner frame members are formed in a hexagonal shape.

6. The ball game apparatus of claim 1, wherein each shaped member of the plurality of shaped members is formed in a trapezoid shape.

7. The ball game apparatus of claim 1, wherein the raised platform surface is formed in a hexagonal shape.

8. The ball game apparatus of claim 1, wherein a floor markings layout is disposed around the centerpiece apparatus, the floor markings layout including an area into which, during a serve, the ball member must bounce after having first bounced off the raised platform surface during the serve.

9. The ball game apparatus of claim 8, wherein the floor markings layout include one or more first shaped zones disposed at a first distance away from the centerpiece apparatus and one or more second shaped zones disposed at a second distance away from the centerpiece apparatus, and wherein the floor markings layout provide a pattern of floor marking areas that is symmetrical to the centerpiece apparatus such that an even number of players will participate in a ball game using the ball game apparatus.

10. The ball game apparatus of claim 1, wherein the elastic member comprises an inflatable ball and an amount of air inside the inflatable ball controls the bounce characteristic off the shaped member.

11. A ball game apparatus configured for a plurality of players, the ball game apparatus comprising:

a centerpiece apparatus member having an outer frame member, an inner frame member disposed inside the outer frame member, and a raised platform surface disposed within the inner frame member so as to be mounted at a level above the outer frame member, the outer frame member configured with a plurality of vertical faces corresponding in number to a number of players in the plurality of players and configured such that an elastic ball can bounce off an outer surface of any of the outer frame vertical faces;

a plurality of shaped members, corresponding in number to the number of players and coupled between the outer and inner frame members, each shaped member associated with a respective one of the vertical faces of the outer frame members to be facing a respective player position of one player of the plurality of players and each shape member configured such that the elastic ball can bounce off a top surface of the shaped member;

at least one sensor coupled to the centerpiece apparatus; and a light emitting member coupled to the at least one sensor, wherein the light emitting member emits a first colored light when the at least one sensor detects contact by the ball member on the raised platform surface or on any of the plurality of shaped members and a second colored light when the at least one sensor detects contact by the ball member on any vertical face of the outer frame member, and wherein a top end of the outer frame member is spaced from a top end of the inner frame member, the plurality of shaped members are coupled between the top end of the outer frame member and the top end of the inner frame member.

12. The ball game apparatus of claim 11, wherein the outer frame member and the inner frame member are formed in a polygonal shape.

13. The ball game apparatus of claim 12, wherein the outer frame member and the inner frame member are formed in a hexagonal shape.

14. The ball game apparatus of claim 11, wherein each shaped member of the plurality of shaped members is angled with respect to the raised platform surface.

15. The ball game apparatus of claim 11, wherein each shaped member of the plurality of shaped members is formed in a trapezoid shape.

16. The ball game apparatus of claim 11, wherein the raised platform surface is formed in a hexagonal shape.

17. The ball game apparatus of claim 14, wherein the outer and inner frame members are formed in a hexagonal shape.

18. The ball game apparatus of claim 11, further comprising a plurality of elastic members corresponding in number to the number of the plurality of shaped members, each elastic member disposed between the outer frame member and the inner frame member and a respective one of the shaped members, the elastic members configured to control a bounce characteristic of the ball member off the top surfaces of the shaped members.

* * * * *